United States Patent [19]

Hauser et al.

[11] Patent Number: 4,732,821

[45] Date of Patent: Mar. 22, 1988

[54] NICKEL-BASED ELECTRICAL CONTACT

[75] Inventors: Joachim J. Hauser, Summit; Andreas Leiberich, New Providence; John T. Plewes, Chatham; Murray Robbins, Berkeley Heights, all of N.J.

[73] Assignee: American Telephone and Telegraph Company, AT&T Bell Laboratories, Murray Hill, N.J.

[21] Appl. No.: 30,761

[22] Filed: Mar. 25, 1987

Related U.S. Application Data

[63] Continuation-in-part of Ser. No. 823,986, Jan. 30, 1986, abandoned, which is a continuation-in-part of Ser. No. 735,779, May 20, 1985, abandoned.

[51] Int. Cl.[4] ..... H01H 1/02

[52] U.S. Cl. ..... 428/671; 428/929; 428/680; 423/644

[58] Field of Search ..... 428/671, 929, 939, 616, 428/680, 624; 423/644, 648 R

[56] References Cited

U.S. PATENT DOCUMENTS 3,641,298 2/1972 Broverman ..... 200/166 C
4,503,131 3/1985 Baudsand ..... 428/672

OTHER PUBLICATIONS

S. M. Garbe and A. Solomon, 1972, "Contact Properties of Nickel Containing Alloys" pp. 195–196.

*Primary Examiner*—Christopher W. Brody
*Attorney, Agent, or Firm*—Peter A. Businger

[57] ABSTRACT

Nickel material comprising controlled amounts of hydrogen has low electrical contact resistance even after prolonged exposure to an oxidizing ambient. When used as a surface layer on an electrically conducting member, such material is suitable as a contact material and represents an inexpensive alternative to gold. And, when prepared in the form of microscopic flakes, such material is suitable for use in electrically conductive inks and adhesives.

14 Claims, 2 Drawing Figures

NICKEL-BASED ELECTRICAL CONTACT

CROSS-REFERENCE TO RELATED APPLICATIONS

This is a continuation-in-part application of application Ser. No. 823,986, filed Jan. 30, 1986 (now abandoned) which was a continuation-in-part application of application Ser. No. 735,779, filed May 20, 1985 (now abandoned).

TECHNICAL FIELD

The invention is concerned with electrical contact surface materials and, in particular, with nickel-based materials.

BACKGROUND OF THE INVENTION

Typically, the manufacturer of high-quality electrical contacts has involved the usage of gold whose properties of low contact resistance and high chemical stability are key advantages in such usage. However, as the price of gold remains high, efforts continue at finding alternative materials for contact manufacture. Prominent among such alternatives are precious metals other than gold; e.g., silver-palladium alloys have been found suitable for certain applications.

While such alternate alloys are less expensive than gold, still further cost reduction is desired, and nonprecious metal alloys such as, e.g., copper-nickel alloys have been investigated for contact resistance and stability over time. See S. M. Garte et al., "Contact Properties of Nickel-Containing Alloys", *Electrical Contacts,* 1972, Illinois Institute of Technology.

SUMMARY OF THE INVENTION

It has been discovered that a material consisting essentially of nickel and a controlled amount of hydrogen has contact properties comparable to those of gold such as, in particular, low and stable contact resistance. Preferred amounts of hydrogen in nickel are regarded to be such as to associate atoms of hydrogen with nickel atoms on dislocations, thus blocking oxidation at critical sites. Typically, surface contact resistance of the material is significantly less than 100 milliohms even after prolonged exposure to an oxidizing ambient.

DESCRIPTION

Figure 1:
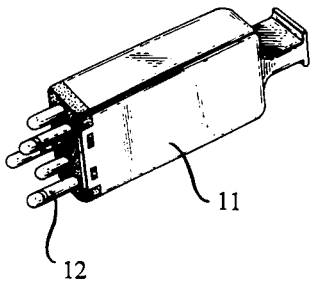
FIG. 1 is a perspective view of an electrical connector device in accordance with the invention.

The electrical connector device shown in FIG. 1 comprises housing 11 and contact pins 12. Housing 11 is made of an electrically insulating material, and contact pins 12 have contact surfaces in accordance with the invention.

Figure 2:
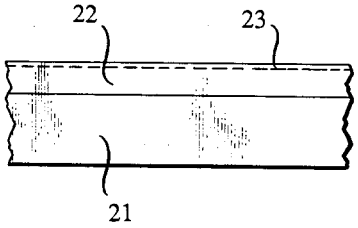
FIG. 2 is a schematic cross-sectional view of a portion of a device in accordance with the invention.

Shown in FIG. 2 are, in cross section, an electrically conducting member 21 on which layer 22 is situated. Member 21 may consist of a copper conductor material, and surface layer 22 is a nickel material which comprises hydrogen at least in a surface region 23. The incorporation of controlled amounts of hydrogen into nickel material results in enhanced contact properties such as low contact resistance and long-term stability of such resistance.

Hydrogen may be incorporated in a nickel material in a variety of ways such as, e.g., in the course of electroplating, by sputtering in an argon-hydrogen atmosphere, and by in-diffusion at a bulk surface which, preferably, has been subjected to plastic deformation by cold working. Preferred concentrations of hydrogen depend on conditions under which layers or bodies of nickel are produced and processed, and it is postulated that preferred concentrations increase in direct relationship with the number of nickel atoms on dislocations. In particular, greater amounts of hydrogen are beneficial for cold worked material, preferred amounts being directly related to level of cold working. In the case of electrodeposited layers, preferred amounts are in the range of from 0.002 to 0.02 atom concentration of hydrogen in nickel; when severe cold work is applied up to 0.2 atom concentration is preferred. (Such preferred amounts of hydrogen in nickel may be compared with much lower atom concentrations of hydrogen of approximately 0.0005 as observed in commerically available nickel material such as nickel foil).

Fortuitously, as dislocation slip bands produced by cold working also facilitate in-diffusion of hydrogen, contact properties of cold-worked bulk nickel material are most favorably affected by hydrogen in-diffusion. Accordingly, applications are preferred in which nickel material is plastically deformed by a significant amount, such as, e.g., corresponding to at least 50 percent reduction of cross-sectional area prior to hydrogen diffusion, the latter being carried out at a temperature which is less than the recrystallization temperature of Ni. Hydrogen in-diffusion is typically effected over a time of a few minutes, and in-diffusion is facilitated by heating at a temperature below the recrystallization temperature of Ni. Among applications of cold-worked material are those involving the use of microscopic flakes dispersed or embedded in a non-conductive matrix material as, e.g., in electrically conducting inks, pastes, and adhesives. (Manufacture of nickel flakes or particles is well-known in the art and may involve cold working by roll-flattening. Hydrogen may be incorporated in flakes or particles, e.g., by diffusion treatment as mentioned above, and such treatment may be carried out. e.g., in a rotating furnace and under pure hydrogen at atmospheric pressure. At a preferred temperature of 200–250 degrees C., typical diffusion treatment time is in the range from 15–30 minutes.)

Conveniently, hydrogen can be incorporated in nickel layers by electroplating out of a suitable nickel bath, solutions of nickel salts being considered most suitable where the anion is but weakly oxidizing.

While a contact material of the invention may be free or essentially free of elements other than nickel and hydrogen, impurities may be present and additional elements may be included such as, e.g., boron, silicon, germanium, phosphorus, arsenic, antimony, or bismuth. When present in solid solution or, in other words, when incorporated in the nickel structure, impurities and additives are considered not to interfere with the beneficial effect of hydrogen in nickel. Amounts of at least 70 atom percent nickel-hydrogen are preferred in the contact material.

Contacts of the invention may receive a final coating or "flash" comprising a significant amount of a coating material such as gold, one or several platinum-group elements, or gold and one or several platinum-group elements, the amount being sufficient to impart to the coated surface the appearance of such coating material.

The structure of such coating may be essentially homogeneous or layered, and coating thickness typically is in a range of from 0.01 to 0.05 micrometer. For example, a cobalt-hardened gold coating may be electro-deposited from a slightly acidic solution (pH 5) comprising potassium gold cyanide, cobalt hausdcitride, and a citric buffer. (The presence of cobalt, nominally in a range of from 0.2 to 0.5 percent by weight, enhances surface hardness especially in the case of thicker coatings.) Preferred temperature of the plating bath is approximately 35 degrees, and a plating current of approximately 5 milliamperes per $cm^2$ is convenient. Typical plating times are of the order of half a minute. Prior to plating, a surface may be cleaned, e.g., by electrolytic scrubbing in an alkaline solution, rinsing in deionized water, and dipping in dilute hydrochloric acid at elevated temperature.

EXAMPLE 1

A layer having a thickness of approximately 1.68 micrometer and having approximately 0.005 atom concentration of hydrogen in nickel was deposited on a copper substrate by sputtering from an essentially pure nickel target in an atmosphere of approximately 10 percent by volume hydrogen, remainder essentially argon. The layer was exposed to atmospheric test conditions at 75 degrees C. and 95 percent relative humidity for 65 hours. After such exposure contact resistance was determined to be in the range of from 7 to 10 milliohms.

EXAMPLE 2

A layer having a thickness of approximately 0.48 micrometer was deposited as further described in Example 1 above. Ultimate contact resistance was in the range of from 10 to 13 milliohms.

EXAMPLE 3

A layer having a thickness of approximately 4.5 micrometers was deposited on a copper substrate by electroplating from a 2-molar nickel chloride solution at a temperature of approximately 75 degrees C., pH of the solution was approximately 3 as obtained by the addition of ammonium hydroxide, and current density during deposition was approximately 150 milliamperes/$cm^2$. The layer was exposed to atmospheric test conditions as described in Example 1 above, and contact resistance was determined to be in the range of from 1 to 10 milliohms.

EXAMPLE 4

A layer was deposited as described in Example 3 above except that a 2-molar nickel citrate solution was used at a pH of approximately 6. Contact resistance of the layer was found to be in the range of from 0.8 to 10 milliohms.

EXAMPLE 5

A layer was deposited as described in Example 3 above except that a ½-molar nickel acetate solution was used at a pH of approximately 8. Contact resistance of the layer was in the range of from 2 to 15 milliohms.

What is claimed is:

1. Device comprising an electrically conducting member having a contact surface, said contact surface comprising the surface of at least a portion of a surface region of said member, said surface region consisting essentially of a contact material, an amount of at least 70 atom percent of said contact material consisting of nickel and hydrogen, and hydrogen being present in said amount in a concentration which results in an enhanced electrical contact property of said contact surface.

2. Device of claim 1 in which the contact resistance of said contact surface is less than 100 milliohms.

3. Device of claim 1 in which said surface region has been plastically deformed so as to result in cross-sectional area reduction greater than or equal to 50 percent.

4. Device of claim 1 in which said contact surface is essentially the entire surface of said member.

5. Device of claim 4 in which said member is a contact pin.

6. Device of claim 4 in which said member is a conductive particle.

7. Device of claim 6 in which said particle is an ink particle.

8. Device of claim 6 in which said particle is embedded in a non-conductive matrix material.

9. Device of claim 8 in which said non-conductive matrix material is an adhesive material.

10. Device of claim 1 said contact material having a surface coating which consists essentially of a coating material selected from the group consisting of gold, one or several platinum-group elements, and gold and one or several platinum-group elements.

11. Device of claim 10, the amount of said coating material being sufficient to produce a surface appearance of said coating material.

12. Device of claim 10, said surface coating having a thickness in the range from 0.01 to 0.05 micrometer.

13. Device of claim 1, said surface region being an electrodeposited layer in which atom concentration of hydrogen in said amount is in the range from 0.002 to 0.02.

14. Device of claim 1, said surface region being a layer which has been plastically deformed and in which atom concentration of hydrogen in said amount is less than or equal to 0.2.

* * * * *